US009630743B2

(12) United States Patent
Lee et al.

(10) Patent No.: US 9,630,743 B2
(45) Date of Patent: Apr. 25, 2017

(54) TRAY FOR CARRYING VEHICLE WHEEL

(71) Applicant: KOREA CONTAINER POOL CO., LTD., Seoul (KR)

(72) Inventors: Chun Woo Lee, Seoul (KR); Sang Hoon Park, Seoul (KR)

(73) Assignee: KOREA CONTAINER POOL CO., LTD., Seoul (KR)

( * ) Notice: Subject to any disclaimer, the term of this patent is extended or adjusted under 35 U.S.C. 154(b) by 0 days.

(21) Appl. No.: 14/760,263

(22) PCT Filed: Jun. 5, 2015

(86) PCT No.: PCT/KR2015/005684

§ 371 (c)(1),
(2) Date: Jul. 10, 2015

(87) PCT Pub. No.: WO2015/186995

PCT Pub. Date: Dec. 10, 2015

(65) Prior Publication Data

US 2016/0251114 A1 Sep. 1, 2016

(30) Foreign Application Priority Data

Jun. 5, 2014 (KR) ..... 10-2014-0068226

(51) Int. Cl.
*B65D 19/00* (2006.01)
*B65D 19/44* (2006.01)
(Continued)

(52) U.S. Cl.
CPC ..... *B65D 19/44* (2013.01); *B65D 19/0002* (2013.01); *B65D 19/0032* (2013.01); *B65D 71/70* (2013.01); *B65D 85/06* (2013.01); *B65D 2519/00268* (2013.01); *B65D 2519/00288* (2013.01); *B65D 2519/00318* (2013.01);
(Continued)

(58) Field of Classification Search
CPC ..... B65D 19/44; B65D 19/0002; B65D 19/0032; B65D 2519/0081; B65D 2519/00815; B65D 85/02; B65D 85/06; B65D 2585/6882; B65D 71/70
See application file for complete search history.

(56) References Cited

U.S. PATENT DOCUMENTS 2,704,600 A * 3/1955 Despres ..... B65D 71/70 206/392
4,838,419 A * 6/1989 Weits ..... B65D 71/70 206/386

(Continued)

FOREIGN PATENT DOCUMENTS

| | | |
|---|---|---|
| JP | 08-091342 | 4/1996 |
| JP | 2000-289741 | 10/2000 |
| JP | 2001-130664 | 5/2001 |

*Primary Examiner* — Daniel Rohrhoff

(57) ABSTRACT

Disclosed is a tray for carrying a vehicle wheel, including: a base plate; and multiple wheel holders which are formed on the base plate to be separated and on which a vehicle wheel is seated, wherein the wheel holder includes a holding body that protrudes upward on the base plate and wherein the sliding parts extended from the holding body and the sliding part is formed to be inclined downward outward in a radial direction of the wheel holder and inclined in a horizontal direction of the base plate to easily separate the vehicle wheel.

11 Claims, 8 Drawing Sheets

(51) Int. Cl.
*B65D 85/06* (2006.01)
*B65D 71/70* (2006.01)

(52) U.S. Cl.
CPC ..... *B65D 2519/00348* (2013.01); *B65D 2519/00815* (2013.01); *B65D 2519/00965* (2013.01)

(56) References Cited

U.S. PATENT DOCUMENTS

| | | | | |
|---|---|---|---|---|
| 5,826,716 | A * | 10/1998 | Wilson | B65D 71/70 206/304 |
| 6,484,877 | B1 * | 11/2002 | Murakami | B65D 19/44 108/55.3 |
| 8,449,931 | B2 * | 5/2013 | Dubrovsky | A23G 4/08 426/3 |
| 2004/0255827 | A1 * | 12/2004 | de Barros, Jr. | B65D 19/44 108/55.1 |
| 2006/0124478 | A1 * | 6/2006 | Marcao | B65D 19/44 206/304 |
| 2007/0138037 | A1 * | 6/2007 | Hasenbusch | B65D 57/00 206/303 |

* cited by examiner

< Prior Art >

< Prior Art >

CROSS-SECTION IN HORIZONTAL DIRECTION

CROSS-SECTION IN LONGITUDINAL DIRECTION

TRAY FOR CARRYING VEHICLE WHEEL

This application claims the priority of Korean Patent Application No. 10-2014-0068226, filed on Jun. 5, 2014 in the KIPO (Korean Intellectual Property Office), the disclosure of which is incorporated herein entirely by reference. Further, this application is the National Stage application of International Application No. PCT/KR2015/005684, filed Jun. 5, 2015, which designates the United States and was published in Korean. Each of these applications is hereby incorporated by reference in their entirety into the present application.

TECHNICAL FIELD

The present invention relates to a tray for carrying a vehicle wheel, and particularly, to a tray for carrying a vehicle wheel having a structure in which a worker can take out a wheel without applying excessive force to a wheel carried while being load on a tray for assembly of a vehicle.

BACKGROUND ART

In general, a vehicle is produced through a press process that processes a steel plate, a vehicle body assembly process that completes a vehicle body forming a frame of the vehicle through welding with respect to multiple processed steel plates, a painting process that performs painting an exterior with respect to the completed vehicle body, a part assembly process that assemblies all parts belonging to an automobile, and an inspection process that finally inspects the vehicle of which the assembly is completed.

In the part assembly process glass, a wiring and interior material process which is a foundation process, a suspension device, a steering device, a brake device, an engine/transmission, an exhaust device, a tire, a seat, and a steering wheel are sequentially assembled. The process may be a final step of an automobile assembly process.

Even during the part assembly process, a wheel supply system is installed as a component of a carrying facility for supplying an aluminum wheel of the automobile to a production line. The wheel supply system in the related art is generally constituted by a transport conveyor device in which multiple conveyor rollers are installed and multiple wheels classified for each size and loaded on a pallet are provided in a workspace around the transport conveyor device.

Herein, a worker seats a corresponding wheel among wheels loaded for each size on the conveyor roller of the transport conveyer device through a manual work which the worker directly lifts the corresponding wheel and when the wheels are seated, the transport conveyor device transports the wheels to the corresponding production line which requires the assembly.

Related art associated with transport means of the aluminum wheel mounted on the vehicle may disclose Korean Patent Registration No. 10-1028559 and in detail, provides a wheel loading device for a vehicle, which picks up multiple wheels loaded on the pallet at once regardless of a size in a transport line to seat the multiple wheels on a transport conveyor.

However, the related art discloses a content that multiple wheels are simultaneously carried through a wheel loading device for the vehicle to prevent a musculoskeletal disease of the worker due to the existing manual work and the related art is can be applied regardless of the size of the wheel to improve workability and line operation rate, but when the worker directly takes out the aluminum wheel from the pallet or the tray, a structure required to easily take out the wheel without interference with the tray is incomplete.

In detail, referring to FIGS. 1 and 2, when a worker manually separates a wheel 20 loaded on a tray 10, the worker may separate the wheel 20 after first lifting the wheel 20 from a wheel holder 12 formed on a base plate 11 forming the tray 10 in a vertical direction. This as a relationship in which a lateral surface 14 of the wheel holder 12 in the related art is formed on the base plate 11 in the vertical direction has a limit that the wheel 20 needs to be lifted upward by a predetermined distance in order to prevent interference with a lower end 22 of the wheel 20.

In this case, as illustrated in FIG. 2, an impellent load acts on a joint and a waist of the worker, which may suffer a serious damage while lifting the wheel 20 upward.

DISCLOSURE OF THE INVENTION

Technical Problem

In order to solve the problem, the present invention has been made in an effort to provide a tray for carrying a vehicle wheel, which has a structure in which a worker can easily separate a wheel by pulling the wheel while lifting only one side of a wheel carried while being loaded on a tray for vehicle assembly.

Technical Solution

An exemplary embodiment of the present invention provides a tray for carrying a vehicle wheel, including: a base plate 110; and multiple wheel holders 120 which are formed on the base plate 110 to be separated and on which a vehicle wheel 20 is seated, wherein the wheel holder includes a holding body 123 that protrudes upward on the base plate 110 and sliding parts 121 extended from the holding body 123 and the sliding part 121 is formed to be inclined downward outward in a radial direction of the wheel holder 120 and inclined in a horizontal direction of the base plate 120 to easily separate the vehicle wheel 20.

The sliding parts 121 may be formed on the wheel holder 120 to be symmetric to each other in the horizontal direction of the vehicle wheel 20.

A round portion 130 configuring a corner portion of the base plate 110 may be provided on the base plate 110 and the round portion 130 may have a curvature radius to corresponding to a shape of an outer periphery of the wheel holder 120.

The wheel holders 120 may be deployed to be symmetric to each other around a separation wall 114 formed in a longitudinal direction of the base plate 110.

An opening hole 140 may be formed between the wheel holder 120 and the separation wall 114.

Advantageous Effects

A tray for carrying a vehicle wheel according to the present invention enables a worker to easily separate a wheel by pulling the wheel while lifting only one side of a wheel carried while being loaded on a tray for vehicle assembly to remarkably reduce a load applicable to a joint or a waist of the worker.

MODE FOR CARRYING OUT THE INVENTION

Figure 1:
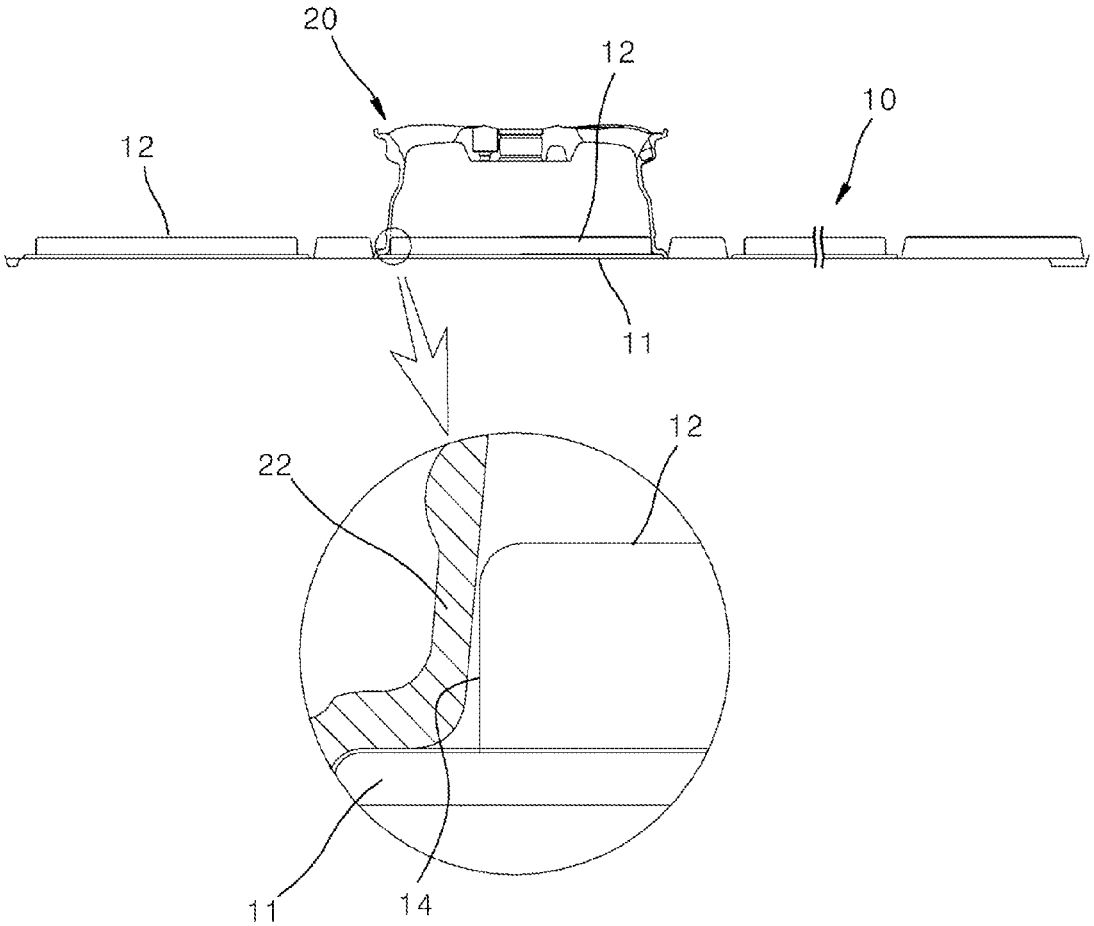
FIG. 1 is a diagram illustrating a tray for carrying a vehicle wheel in the related art.
Figure 2:
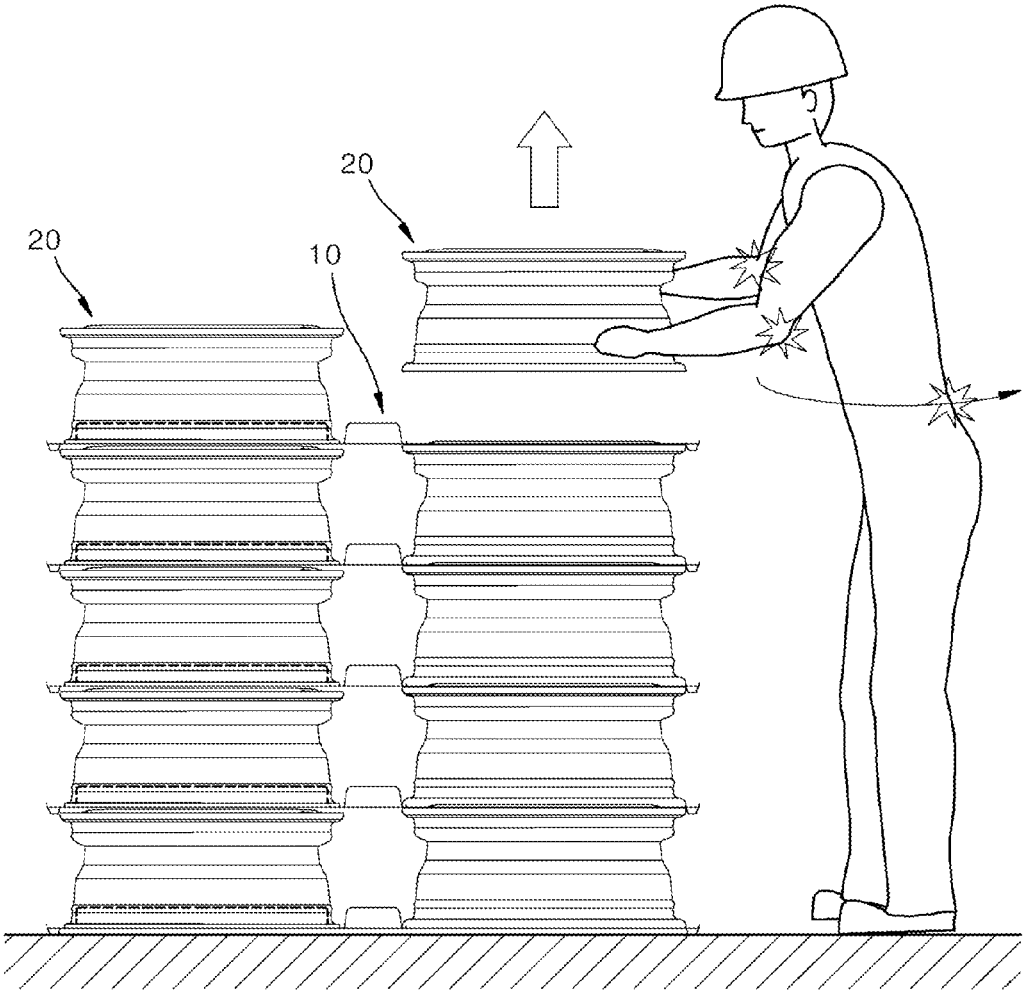
FIG. 2 is a diagram illustrating a state in which a worker lifts a wheel by using the tray for carrying a vehicle wheel in the related art.

Hereinafter, an exemplary embodiment of the present invention will be described in more detail with reference to the accompanying drawings.

The following exemplary embodiment is a detailed description for assisting appreciation of the present invention and it is natural that the exemplary embodiment does not limit the claims of the present invention. Accordingly, an equivalent invention that performs the same function as the present invention will be included in the claims of the present invention.

Further, when reference numerals refer to components of each drawing, it is to be noted that although the same components are illustrated in different drawings, the same components are referred to by the same reference numerals as possible. In describing the present invention, when it is determined that the detailed description of the known art related to the present invention may obscure the gist of the present invention, the detailed description thereof will be omitted.

Further, terms such as first, second, A, B, (a), (b), and the like may be used in describing the components of the present invention. The terms are only used to distinguish a constituent element from another constituent element, but nature or an order of the constituent element is not limited by the terms. It should be understood that, when it is described that an element is "connected", "coupled", or "access" to another element, the element may be "directly coupled" or "directly access" to the other element or "connected", "coupled", or "access" to the other element through a third element.

A vehicle wheel carrying tray which is a term used in the present invention may be a tray used to carry a wheel having an aluminum alloy property, which is applied to a vehicle, but is not limited thereto and may be applied even to carrying other types of wheels or tires.

Figure 3:
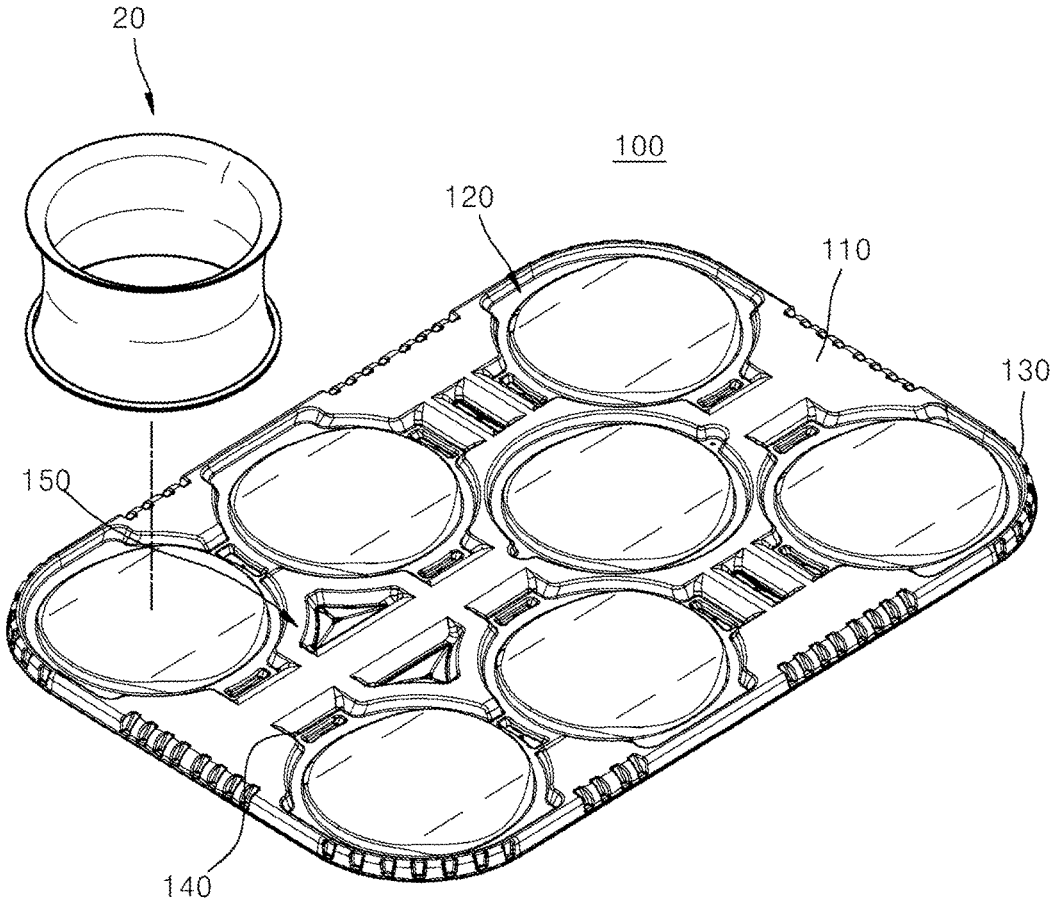
FIG. 3 is a perspective view illustrating a state in which an aluminum wheel is laid on a tray for carrying a vehicle wheel according to the present invention.
Figure 4:
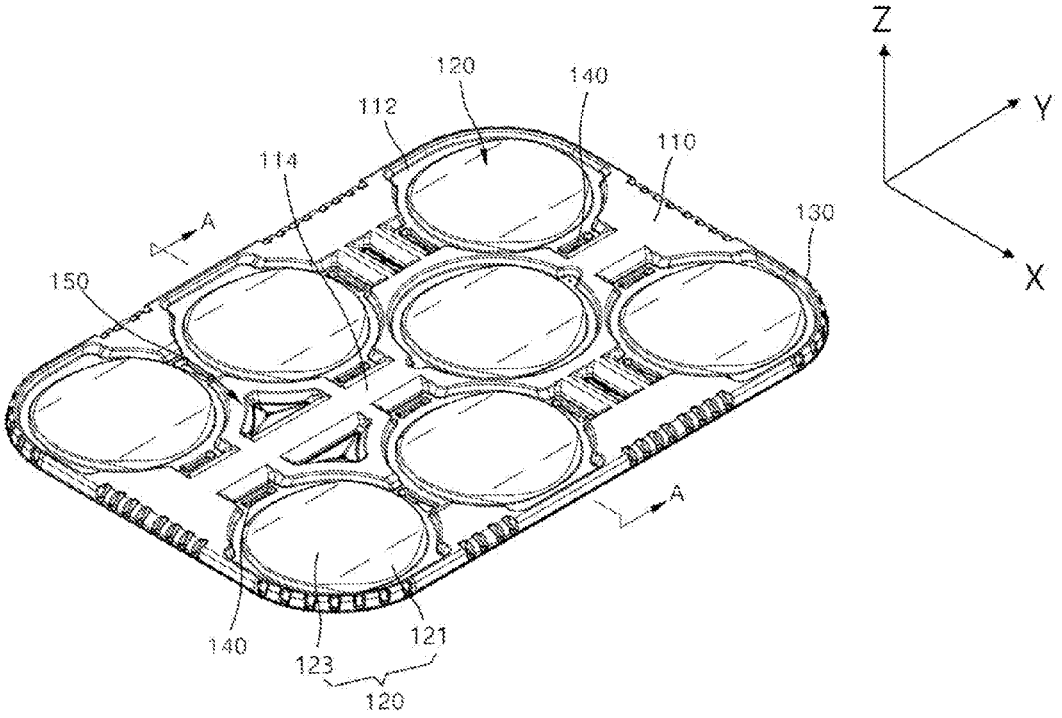
FIG. 4 is a perspective view singly illustrating the tray for carrying a vehicle wheel according to the present invention.

Hereinafter, a vehicle wheel carrying tray 100 according to the present invention will be described with reference to FIGS. 3 to 5.

In the present specification, an X-Y-Z coordinate system may be introduced in order to set a transport direction and a wheel separation direction of the vehicle wheel carrying tray 100. An X axis on the coordinate system which designates a horizontal direction of the tray 100 is set as a direction in which the vehicle wheel 20 is separated from the tray 100, a Y axis which designates a longitudinal direction of the tray 100 is set as a transport direction of the tray 100 on which the wheel 20 is loaded, and a Z axis which designates a vertical direction is set as a direction in which the tray 100 is stacked in multiple stages.

The vehicle wheel carrying tray 100 used as a plate-shaped carrying medium which may carry the wheel made of an aluminum alloy while the wheel is seated may be changed even to a frame or a pallet.

In detail, the vehicle wheel carrying tray 100 includes a base plate 110, multiple wheel holders 120 which are formed on the base plate 110 to be separated and on which the vehicle wheel 20 is seated, a round portion 130 configuring a corner portion of the base plate 110, an opening hole 140 deployed adjacent to the bottom of the wheel holder 120, and depression portions 150 deployed to be opposite to each other around a separation wall 114 formed in the longitudinal direction on the base plate 110.

The wheel holder 120 is formed in such a manner that a diameter of the bottom of the wheel holder 120 corresponds to a diameter of an inner periphery of the vehicle wheel in order to prevent the vehicle wheel 20 from being oscillated. The wheel holder 120 may have a structure in which multiple wheel holders 120 are arranged in line.

The wheel holder 120 includes a holding body 123 that protrudes upward on the base plate 110 and sliding parts 121 deployed at both sides in the horizontal direction from the holding body 123.

The sliding part 121 is formed to be inclined downward outward in a radial direction of the holding body 123, consequently, the sliding part 121 is preferably formed in the separation direction of the vehicle wheel 20.

The round portion 130 is configured to have a predetermined curvature radius to correspond to a shape of an outer periphery of the wheel holder 120. The vehicle wheel carrying tray 100 is stacked in multiple stages in the vertical direction while carrying and fixed by a method that covers a peripheral portion by using a separate packing material in order to prevent oscillation and in this case, the round portion 130 processed to be round prevents the packing material from being damaged to keep a stable stacking structure of the vehicle wheel carrying tray 100.

The opening hole 140 is formed in a receiving groove 112 on the base plate 110 on which the wheel holder 120 is deployed and discharges moisture which may stay in the receiving groove 112 to the outside.

Figure 5:
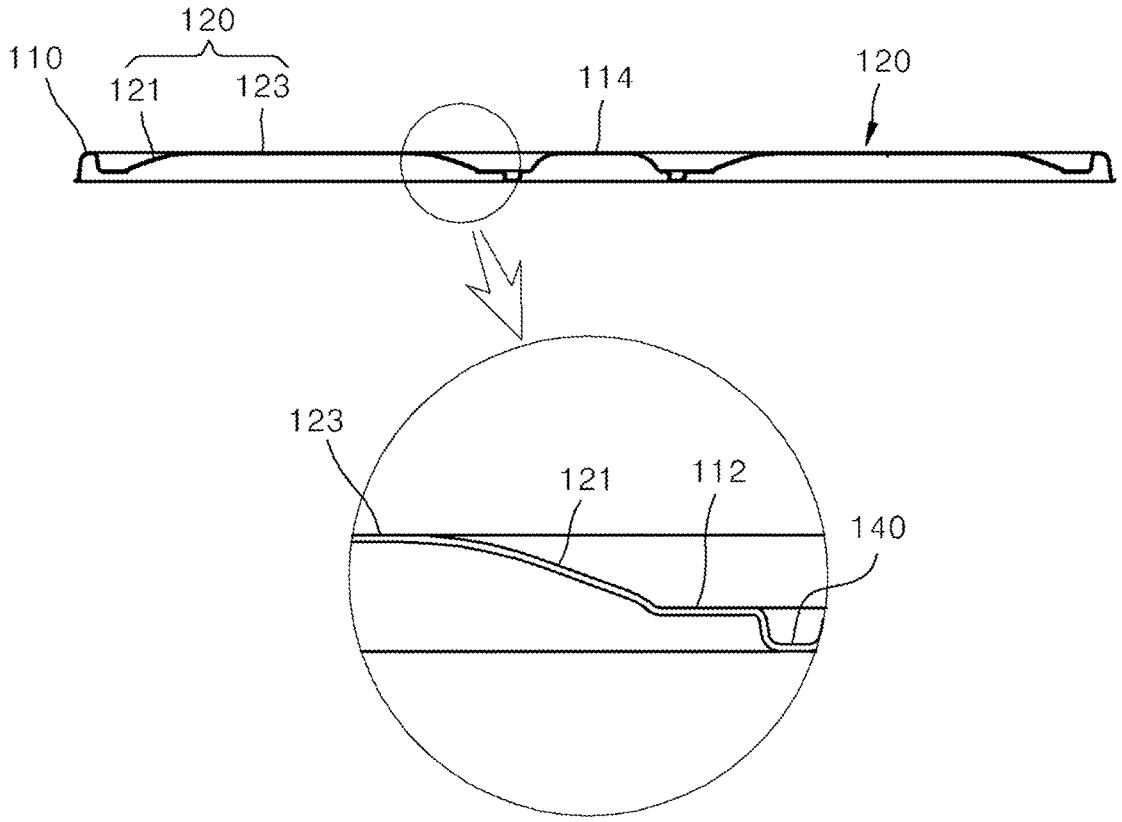
FIG. 5 is a cross-sectional view taken along line A-A of FIG. 4.

Referring to FIG. 5, a cross-section in the horizontal direction of the vehicle wheel carrying tray 100 is illustrated and it can be seen that a pair of wheel holders 120 are deployed to be symmetrical to each other around the separation wall 114 and the opening hole 140 is formed between the wheel holder 120 and the separation wall 114.

Herein, the sliding part 121 is gently connected to an end of the holding body 123 and an end of the receiving groove 112. That is, a curved surface having a predetermined curvature is formed at a connection point of the sliding part 121 and the holding body 123 and a connection point of the sliding part 121 and the receiving groove 112.

Figure 6:
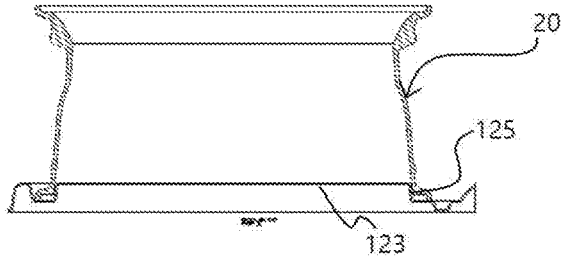
FIG. 6 is a cross-sectional view for a partial area, and a longitudinal direction and a horizontal direction in a plan view in a state in which a wheel for a vehicle is held on the tray for carrying a vehicle wheel.
Figure 6:
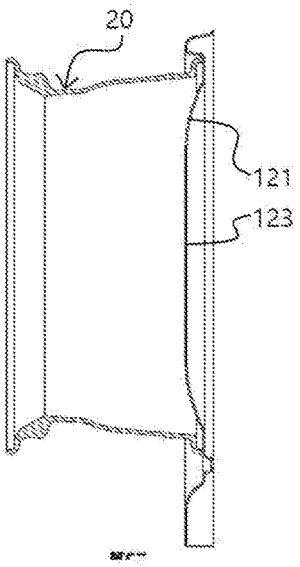
Figure 6:
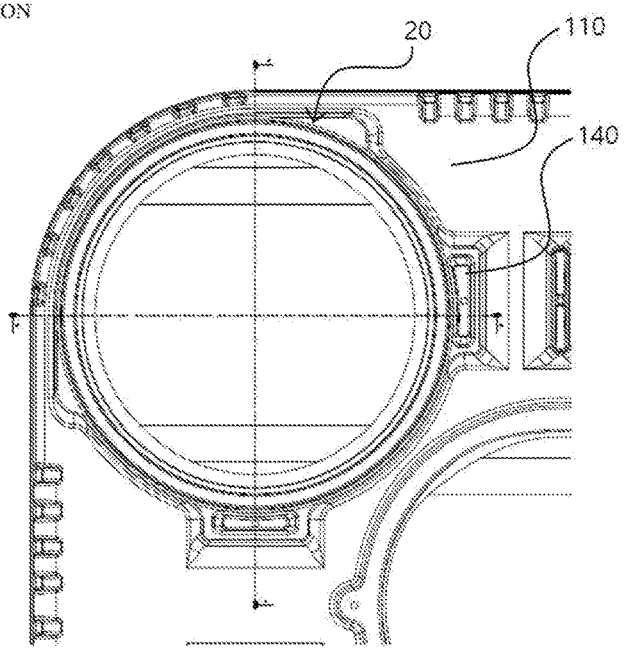

FIG. 6 is a cross-sectional view for a partial area, and a longitudinal direction and a horizontal direction in a plan view in a state in which a wheel 20 for a vehicle is held on the tray 100 for carrying a vehicle wheel.

As illustrated in FIG. 6, the sliding parts 121 are deployed at both sides of the holding body 123 to separate the vehicle wheel 20 on the cross-sectional view in the horizontal direction, but suspension parts 125 are formed at both sides of the holding body 123 in the vertical direction to prevent the vehicle wheel 20 from being oscillated in the longitudinal direction on the cross-sectional view in the longitudinal direction.

Figure 7:
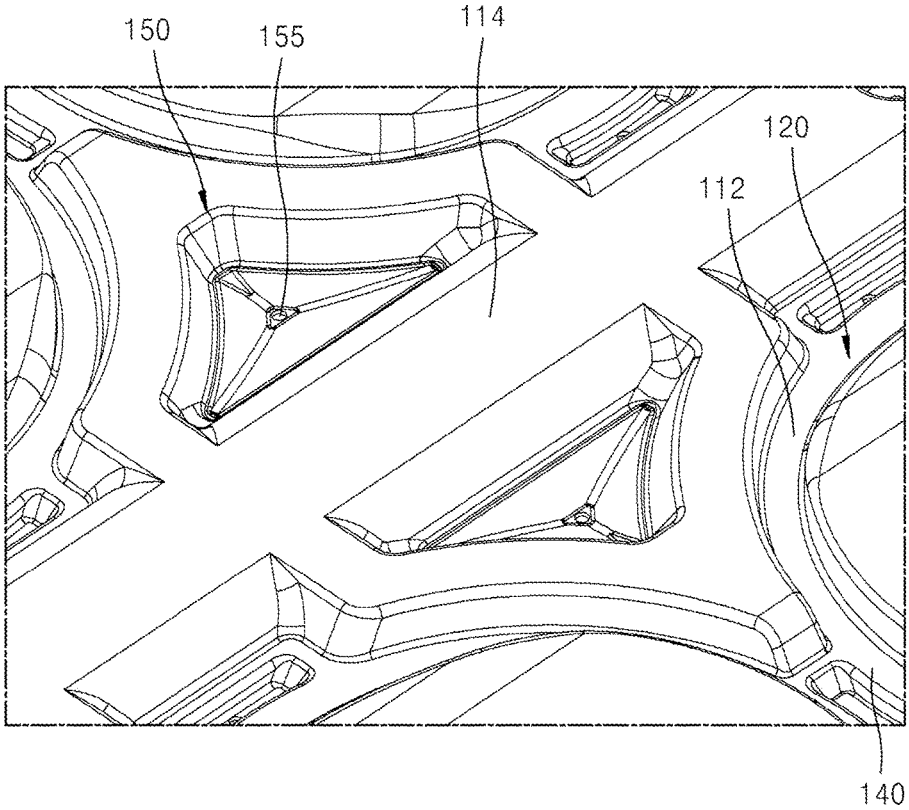
FIG. 7 is an enlarge diagram of a depression portion of FIG. 4.

Referring to FIG. 7, the depression portions 150 are deployed to be opposite to each other around the separation wall 114 formed in the longitudinal direction and inner surfaces are formed to inclined inward from the top of the base plate 110 up to a discharge hole 155 on the bottom.

Figure 8:
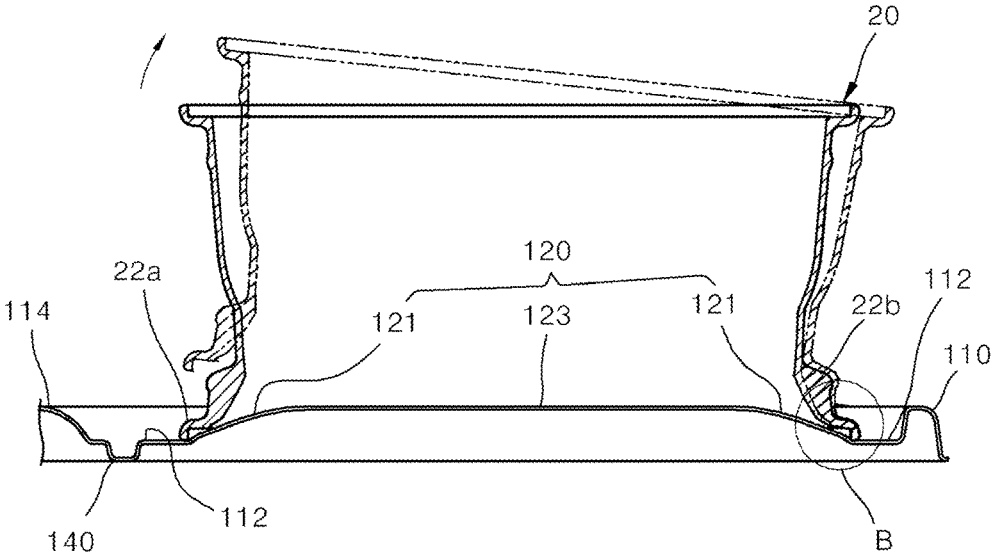
FIG. 8 is a diagram illustrating a state in which one side of the wheel laid on the tray for carrying the wheel is lifted.
Figure 9:
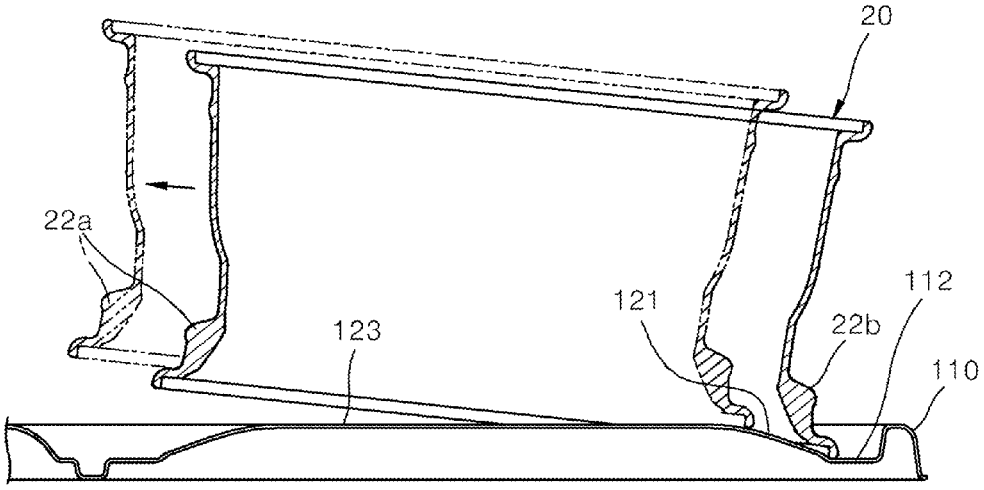
FIG. 9 is a diagram illustrating a state in which the wheel slides in one direction while one side of the wheel is lifted.

Hereinafter, a process in which the vehicle wheel 20 is separated from the tray 100 in the horizontal direction will be described with reference to FIGS. 8 to 10.

First, while the vehicle wheel 20 is seated on the wheel holder 120, one lower side 22*a* of the wheel holder 120 is slightly lifted. During this process, while the other lower side 22*b* of the wheel holder 120 is supported on the receiving groove 112, the vehicle wheel 20 pivots around the other lower side 22*b*.

Figure 10:
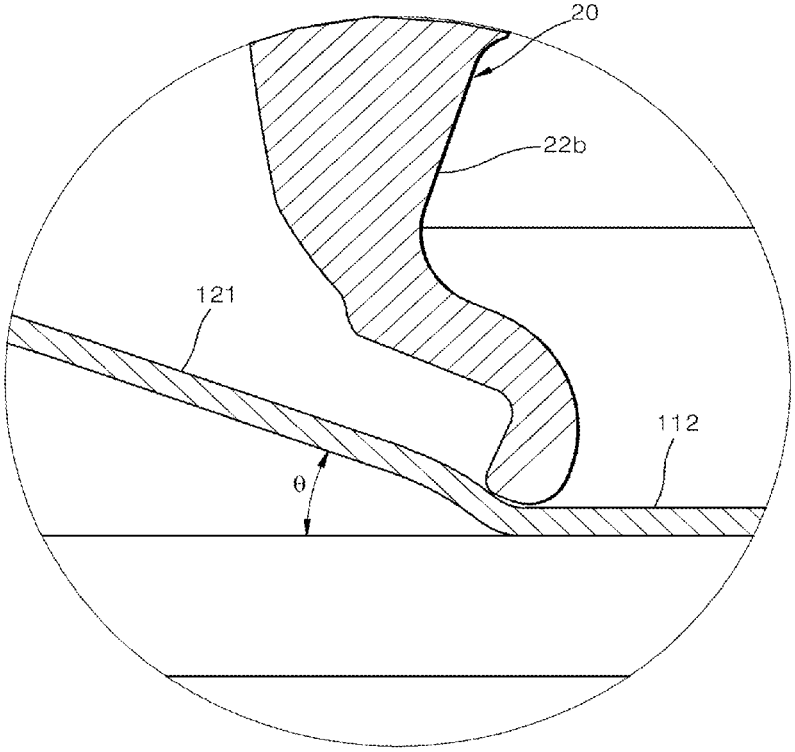
FIG. 10 is an enlarge diagram of part B of FIG. 7.

In detail, as illustrated in FIG. 10, since an end of the other lower side 22*b* is deployed at a coupling point of the sliding part 121 and the receiving groove 112 and the sliding part 121 is inclined at an inclination angle θ, the vehicle wheel 20 may easily rotate around the bottom of the sliding part 121.

Meanwhile, in some cases, it may be anticipated that the other lower side 22*b* is suspended on an outer end of the receiving groove 112 according to a diameter size of the vehicle 20. In this case, the tray pivots in the same manner as illustrated in FIG. 9.

As such, when only one side of the vehicle wheel 20 is lifted while the other side of the vehicle wheel 20 is supported, force required by the worker is reduced.

Next, one lifted lower side 22*a* of the wheel holder 120 is pulled in the horizontal direction by the worker. Herein, the other lower side 22*b* of the wheel holder 120 moves through the sliding part 121 gently connected to the end of the receiving groove 112.

That is, the when the worker separates the wheel 20 from the tray 100, the wheel 20 may be separated by lifting only one side of the vehicle wheel 20 at a predetermined height without performing overall vertical movement and thereafter, pulling the one side toward the worker.

As such, according to the present invention, when the vehicle wheel 20 is separated in order to assemble the vehicle wheel 20 to the vehicle, the load applied to a human body of the worker to prevent a disease which may occur in the human body.

Although the preferred exemplary embodiment of the present invention has been described as above, the present invention is not limited to the aforementioned specific exemplary embodiment. That is, it should be appreciated by those skilled in the art that multiple changes and modifications of the present invention can be made without departing from the spirit and the scope of the appended claims and equivalents to all appropriate changes and modifications are also included in the scope of the present invention.

The invention claimed is:

1. A tray for carrying a vehicle wheel comprising:

a base plate;

multiple wheel holders formed on the base plate to be separated and on which a vehicle wheel is seated; and multiple receiving grooves, each of which is surrounding the wheel holder;

wherein each wheel holder includes a holding body that protrudes upward on the base plate and sliding parts extended from the holding body;

wherein at both ends in the horizontal direction of the wheel holder, the sliding parts are formed to be inclined downward to easily separate the vehicle wheel;

wherein the sliding parts comprise curved surfaces formed at a connection point of the sliding part and the holding body and a connection point of the sliding part and the receiving groove;

wherein suspension parts are formed at both ends in the longitudinal direction of the wheel holder to prevent the vehicle wheel from being oscillated;

wherein each suspension part connects the holding body and the receiving groove in the vertical direction with respect to the holding body.

2. The tray of claim 1, wherein the sliding parts are formed on each wheel holder to be symmetric to each other in the horizontal direction of the vehicle wheel.

3. The tray of claim 1 further comprising:

a round portion configuring a corner portion of the base plate provided on the base plate, the round portion has a curvature radius to corresponding to a shape of an outer periphery of a wheel holder.

4. The tray of claim 3, wherein the wheel holders are deployed to be symmetric to each other around a separation wall formed in a longitudinal direction of the base plate.

5. The tray of claim 4 further comprising:

an opening hole formed between a wheel holder and the separation wall.

6. The tray of claim 4 further comprising:

depression portions deployed to be opposite to each other around the separation wall formed in the longitudinal direction on the base plate.

7. A tray for carrying a vehicle wheel comprising:

a base plate;

multiple wheel holders formed on the base plate to be separated and on which a vehicle wheel is seated; and a separation wall formed in a longitudinal direction of the base plate, the wheel holders are deployed to be symmetric to each other around the separation wall;

wherein each wheel holder includes a holding body that protrudes upward on the base plate and sliding parts extended from the holding body;

wherein the sliding part is formed to be inclined downward outward in a radial direction of the wheel holder and inclined in a horizontal direction of the base plate to easily separate the vehicle wheel.

8. The tray of claim 7, wherein the sliding parts are formed on each wheel holder to be symmetric to each other in the horizontal direction of the vehicle wheel.

9. The tray of claim 7 further comprising:

a round portion configuring a corner portion of the base plate provided on the base plate, the round portion has a curvature radius to corresponding to a shape of an outer periphery of a wheel holder.

10. The tray of claim 7 further comprising:

an opening hole formed between a wheel holder and the separation wall.

11. The tray of claim 7 further comprising:

depression portions deployed to be opposite to each other around the separation wall formed in the longitudinal direction on the base plate.

* * * * *